United States Patent [19]

Smith et al.

[11] 4,040,196

[45] Aug. 9, 1977

[54] RIFLE

[75] Inventors: Jessop Smith, Gates Mills; Thomas Robert Kocis, Streetsboro, both of Ohio

[73] Assignee: Triple-S Development Co., Inc., Wickliffe, Ohio

[21] Appl. No.: 687,007

[22] Filed: May 17, 1976

[51] Int. Cl.[2] ..... F41C 11/04; F41C 15/08

[52] U.S. Cl. ..... 42/23; 42/69 R

[58] Field of Search ..... 42/23, 24, 69 R, 65

[56] References Cited

U.S. PATENT DOCUMENTS

| | | | |
|---|---|---|---|
| 35,067 | 4/1862 | Allen | 42/65 |
| 435,334 | 8/1890 | Tonks | 42/23 |
| 968,228 | 8/1910 | Audette | 42/23 |
| 1,448,297 | 3/1923 | Hedrick | 42/23 |
| 2,289,098 | 7/1942 | Buhmiller | 42/23 |
| 3,735,517 | 5/1973 | DeHaas et al. | 42/23 |

*Primary Examiner*—Charles T. Jordan

*Attorney, Agent, or Firm*—Donnelly, Maky, Renner & Otto

[57] ABSTRACT

A single-shot rifle having a receiver with a lever-activated falling block action characterized in that the breech-block carries the firing pin, the hammer, the hammer spring retainer, the toggle link which is linked to the lever, and the trigger whereby the entire assembly may be removed from the receiver for cleaning, servicing, or replacement simply by removing the lever-receiver pivot pin. The rifle herein is further characterized in that the receiver has therein an extractor-ejector mechanism which is actuated by the breech-block movements.

7 Claims, 5 Drawing Figures

RIFLE

BACKGROUND OF THE INVENTION

In known single-shot rifles with falling block actions, the falling breech-block, the hammer, the trigger, and the lever are individually pivotally mounted in the receiver whereby assembly as well as disassembly for cleaning, servicing or replacement is a complex, time-consuming undertaking.

SUMMARY OF THE INVENTION

The present invention provides a simple and efficient form of single-shot rifle in which the receiver has a falling block action comprising a breech-block assembly which carries the firing pin, the hammer, the trigger, and the toggle link which is linked to the block actuating lever whereby said action assembly may be inserted into the receiver and operatively connected thereto simply by inserting the lever pivot pin in the receiver.

The present invention is further characterized in that the breech-block movements effect actuation of the extractor-ejector mechanism which is mounted in the receiver separately from the action.

Other objects and advantages will appear from the ensuing description.

DETAILED DESCRIPTION OF A PREFERRED EMBODIMENT

Figure 1:
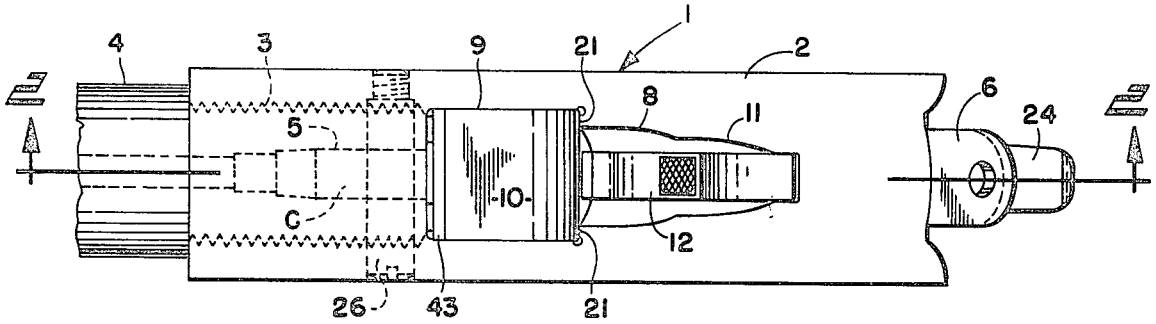
FIG. 1 is a top plan view of a rifle (stock omitted) embodying the present invention.

The rifle 1 herein includes a receiver 2 which as viewed from the top as in FIG. 1 is of generally rectangular form including at its front end a threaded bore 3 for receiving the barrel 4 which has a cartridge-receiving bore 5 arranged so that the rim of the cartridge C will project, say 0.002 to 0.006 inch beyond the end of the barrel 4. The rear end of the receiver 2 has a tang 6 and a threaded hole 7 for connection of the stock (not shown) thereto in well known manner by a screw extending through the hole in the tang 6 and a screw having threaded engagement in the threaded hole 7.

The receiver 1 has a downwardly extending slot 8 therethrough including a wide portion 9 which accommodates a breech-block 10 for vertical movement to the various positions shown in FIGS. 2–5 and a relatively narrower portion 11 to accommodate the hammer 12 and trigger 14 which are pivotally mounted to the breech-block by means of the respective pivot pins 15 and 16 extending through the lower slotted portion of the breech-block 10. The breech-block 10 also provides a cylindrical seat for the cylindrical nut 17 on the retaining screw 18 for the hammer spring 19.

The upper portion of the breech-block 10 reciprocably carries a spring-biased firing pin 20 aligned with the axis of the cartridge C when the breech-block 10 is in its upper firing position wedged between the end of the cartridge C and the inclined rear faces 21 of the receiver slot 9.

Also mounted on the hammer pivot pin 15 is the upper end of a downwardly and forwardly extending link 23 of which the lower end is pivotally connected to the lever 24 by means of the pivot pin 25 and, in turn, the lever 24 is pivotally mounted in the receiver 1 by a shoulder screw 6 which extends through a hole in the receiver and which has its small threaded end screwed into the receiver 1.

Figure 5:
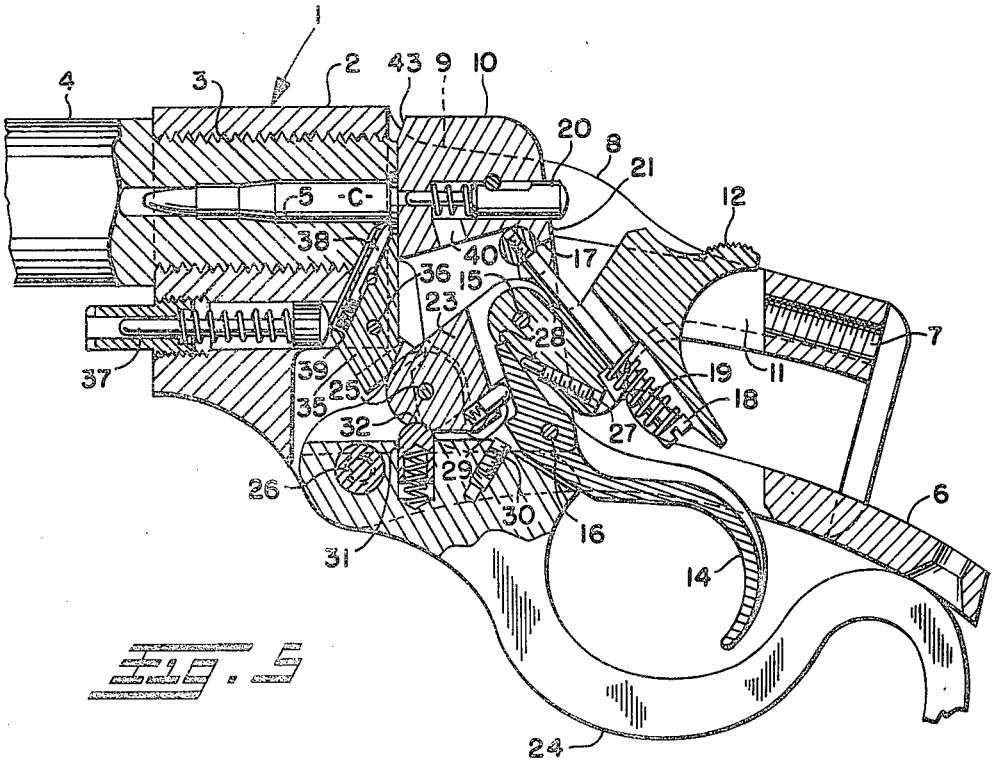

The hammer 12 has an adjusting screw 27 therein which as best shown in FIG. 5 may be adjusted to vary the amount of overlap of the tip of the trigger 14 with the step 28 of the hammer 12 thus to control the sensitivity of the trigger 14. The link 23 carries a spring-biased plunger 29 which engages the trigger 14 to actuate it about its pivot pin 16 when the hammer 12 is being cocked. Another adjusting screw 30 carried by the lever 24 is adjustable to determine the extent of movement of the trigger 14 when pulled to release the hammer 12. The lever 24 also carries a spring-loaded plunger 31 which engages the peripheral cylindrical surface of the link 23 and which, when the lever 24 is closed, as in FIGS. 2 and 5, engages in a recess 32 in the link 23 to constitute a detent to assist in yieldably retaining the lever 24 in closed position. The lever 24 also constitutes a trigger guard.

When the breech-block 10 is in its raised position, wedged as aforesaid, the pivot pins 16, 25 and 26 form, in conjunction with the link 23 and lever arm between pins 25 and 26, a toggle linkage in which the pivot pin 25 is over the dead-center position of the pivots 15 and 26 and in which the compressive load on the link 23 provides an upward force component which firmly locks the breech-block 10 in wedged position between the inclined surfaces 21 and the head of the cartridge C.

Reference will now be made to the extractor-ejector mechanism 35 which is pivotally connected by the pin 36 to the receiver 1, the rear end of the barrel 4 and the corresponding portion of the receiver 1 being slotted as shown to receive the extractor-ejector 35 which is held by the breech-block 10 and by the spring-biased plunger 37 with the tip of the extractor-ejector pin 38 located behind the rim of the cartridge case. When the action is in the FIG. 2 and 5 position, the plunger 37 is engaged above the crown 39 of the extractor-ejector 35 whereby spring pressure tends to retain the extractor-ejector 35 in that position.

Figure 2:
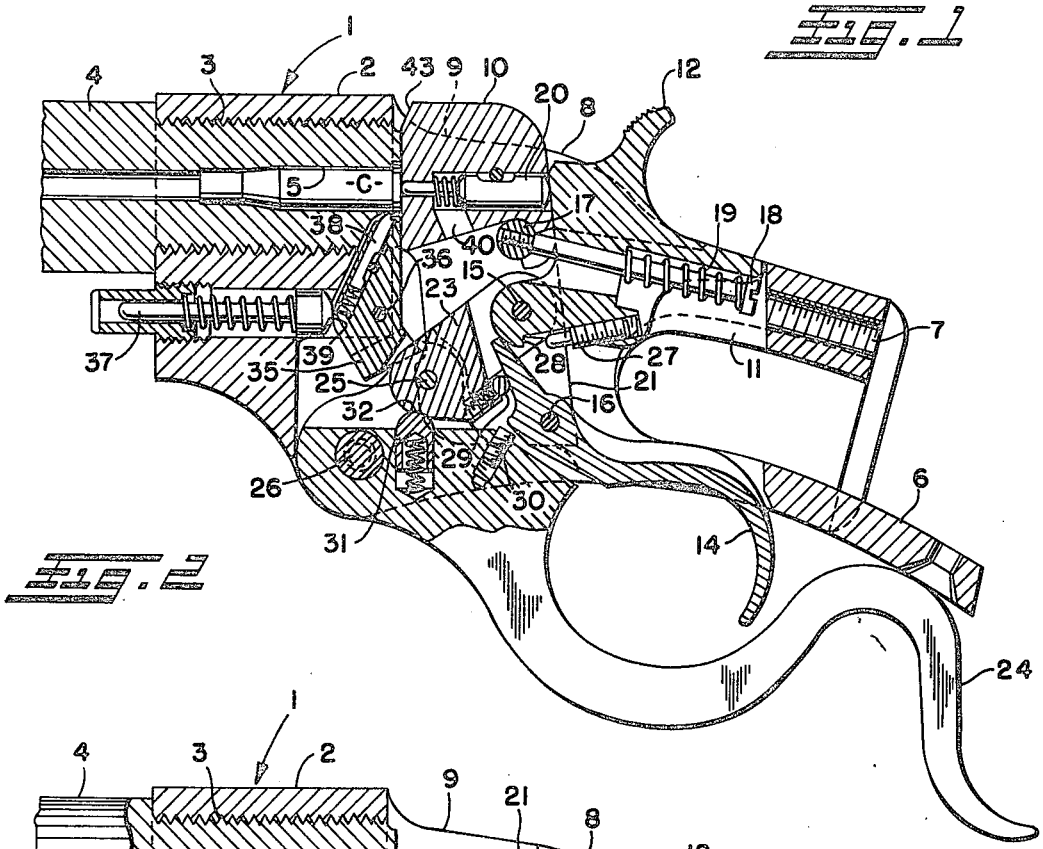
FIG. 2 is a cross section view taken substantially along the line 2—2, FIG. 1, said FIGS. 1 and 2 showing the rifle in its fired condition.

As previously mentioned, FIG. 2 illustrates the receiver and action in the fired condition wherein the hammer 12 has already struck the firing pin 20 to ignite the primer whereby the bullet jacket and lead core will have been shot out of the barrel 4. It is to be noted that the breech-block 10 has a downwardly extending passage 40 which constitutes a gas vent in the event of a pierced primer whereby harmful gas pressure will be directed downward through the gas vent 40 away from the face of and eyes of the shooter.

Figure 3:
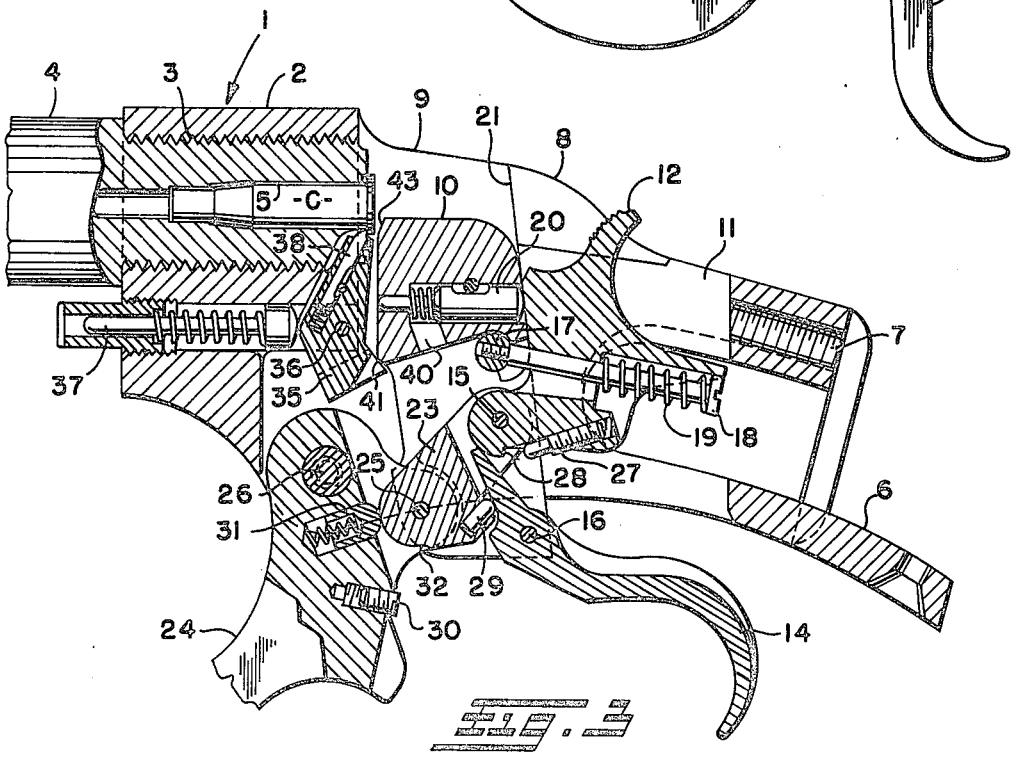
FIGS. 3–5 are cross section views similar to FIG. 2, showing the action in the extract position (FIG. 3), in the eject position (FIG. 4), and in the ready-to-fire position (FIG. 5).

When the lever 24 is actuated downwardly and forwardly from the FIG. 2 position, the pin 25 will be forced below the dead-center position between pivots 15 and 26 and continued movement of the lever 24 to the FIG. 3 position will, through the toggle linkage pull the breech-block 10 assembly downwardly as shown in FIG. 3 whereupon cooperating cam surfaces 41 on the breech-block 10 and on the extractor-ejector 35 will cause slight pivotal movement of the latter in a clockwise direction to extract the cartridge case from the barrel 4 as shown in FIG. 3 and the crown 39 will pass to the upper side of the center line of the pluner 37 and pivot pin 36 so that continued movement of the lever 24 to the FIG. 4 position will cause swinging of the extractor-ejector 35 to the FIG. 4 position by the spring-loaded plunger 37. At the same time, the ejector pin 38 will be snapped outwardly by its spring to eject the shell case.

Figure 4:
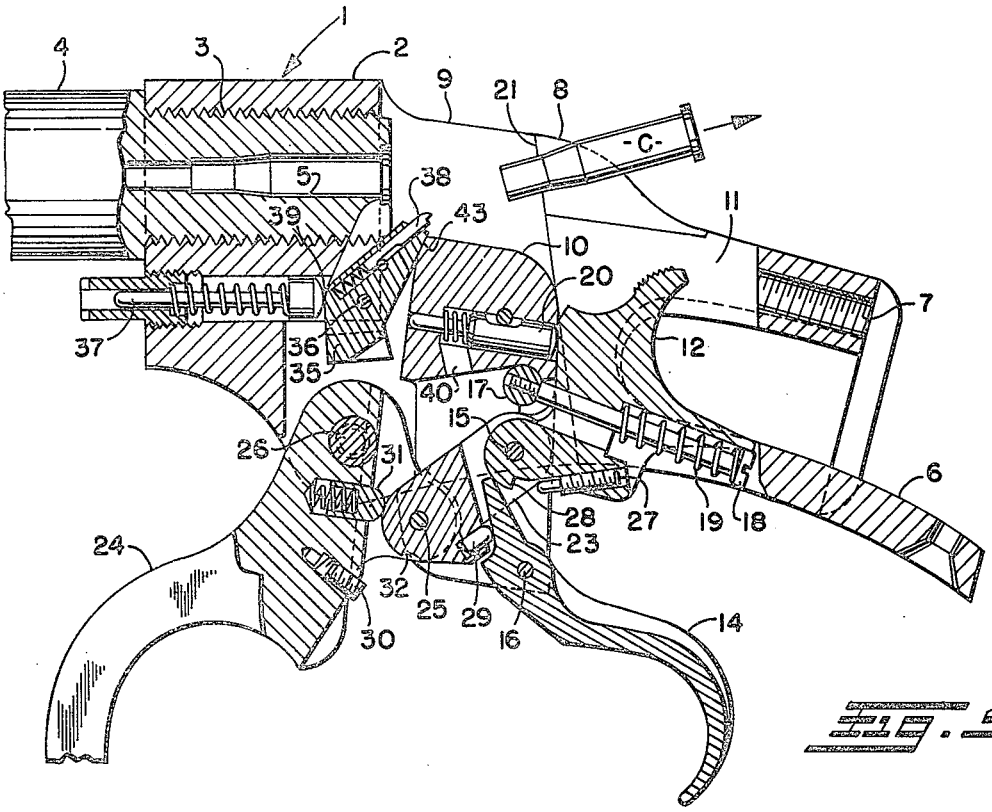

With the action in the FIG. 4 position, the next cartridge C may be inserted into the rear end of the barrel 4, and as the lever 24 is swung counterclockwise from the FIG. 4 position to the FIG. 5 position the breech-block 10 will be elevated to firing position and locked thereat by the toggle link 23, and the upward movement of the breech-block 10 from the FIG. 4 to FIG. 5 position will, through the cam surfaces 43, effect return of the extractor-ejector mechanism 35 to the position shown in FIGS. 2 and 3 wherein the tip of the pin 38 will be behind the rim of the cartridge C, the pin 38 being rounded as shown so as to be cammed down for snapping out behind the cartridge rim.

To fire the cartridge C, the hammer 12 is cocked to the FIG. 5 position and is retained thereat by engagement of the tip of the trigger 14 with the shoulder 28 on the hammer 12 and the hammer spring 19 retains such engagement. When the trigger 14 is pulled to the right as viewed in FIG. 5, the tip thereof will be disengaged from the hammer shoulder 28 whereupon the spring 19 will actuate the hammer 12 in a counterclockwise direction about the pivot pin 14 to strike the rear end of the firing pin 20 to cause the front end of the latter to strike the center primer cap to ignite the powder in the shell case with the expanding gas being effective to fire the bullet through the barrel 4.

As previously mentioned, a distinctive feature of the present invention is the simplicity and economy of construction and assembly and disassembly of the action into and from the receiver 1. For instance by unscrewing the lever pivot pin 26 from the receiver 1, the entire breech-block 10 assembly including the firing pin 20, the hammer 12, the trigger 14, the link 23, the hammer-spring retainer 18 and all of the plungers and adjusting screws associated with the action may be withdrawn downwardly out of the receiver 1 for cleaning, servicing, or replacement. With the action thus removed, the only thing remaining in the receiver 1 is the extractor-ejector mechanism 35 which also is readily accessible for cleaning, servicing or replacement.

The embodiments of the invention in which an exclusive property or privilege is claimed are defined as follows:

1. A receiver for a single-shot rifle having a rifle barrel secured to said receiver and having a lever-activated falling block action; said action comprising a breech-block movable downwardly from a wedged firing position wherein a firing pin carried thereby is aligned with a cartridge in the rifle barrel to a cartridge loading position; a hammer and a trigger each pivotally connected to said block whereby, in said firing position of said breech-block, pulling of the trigger releases said hammer to strike said firing pin; a lever pivotally connected to said receiver and to one end of a link which has its other end pivotally connected to said block to form a toggle linkage to move said block downwardly from and upwardly to said wedged firing position responsive to swinging of said lever in opposite directions; said receiver having a slot from which said action including said firing pin, said hammer, said trigger, said link, and said lever is bodily removable upon removal of the lever-receiver pivot; said link having a spring-biased plunger engaging said trigger at a point radially spaced from the trigger-block pivot to yieldably engage an end of said trigger with a radial shoulder on said hammer.

2. A receiver for a single-shot rifle having a rifle barrel secured to said receiver and having a lever-activated falling block action; said action comprising a breech-block movable downwardly from a wedged firing position wherein a firing pin carried thereby is aligned with a cartridge in the rifle barrel to a cartridge loading position; a hammer and a trigger each pivotally connected to said block whereby, in said firing position of said breech-block, pulling of the trigger releases said hammer to strike said firing pin; a lever pivotally connected to said receiver and to one end of a link which has its other end pivotally connected to said block to form a toggle linkage to move said block downwardly from and upwardly to said wedged firing position responsive to swinging of said lever in opposite directions; said receiver having a slot from which said action including said firing pin, said hammer, said trigger, said link, and said lever is bodily removable upon removal of the lever-receiver pivot; said lever having a spring-biased plunger frictionally engaging said one end of said link.

3. A receiver for a single-shot rifle having a rifle barrel secured to said receiver and having a lever-activated falling block action; said action comprising a breech-block movable downwardly from a wedged firing position wherein a firing pin carried thereby is aligned with a cartridge in the rifle barrel to a cartridge loading position; a hammer and a trigger each pivotally connected to said block whereby, in said firing position of said breech-block, pulling of the trigger releases said hammer to strike said firing pin; a lever pivotally connected to said receiver and to one end of a link which has its other end pivotally connected to said block to form a toggle linkage to move said block downwardly from and upwardly to said wedged firing position responsive to swinging of said lever in opposite directions; said receiver having a slot from which said action including said firing pin, said hammer, said trigger, said link, and said lever is bodily removable upon removal of the lever-receiver pivot; said action having an elongated hammer spring retainer pivotally connected at one end to said block between said hammer-block pivot and said firing pin; said retainer extending rearwardly through a slot in said hammer and through the hammer spring and terminating in a head at its other end engaged by the rear end of the hammer spring.

4. The receiver of claim 3 wherein said hammer has a rearward extension from said slot overlying said hammer spring.

5. A receiver for a single-shot rifle having a rifle barrel secured to said receiver and having a lever-activated falling block action; said action comprising a breech-block movable downwardly from a wedged firing position wherein a firing pin carried thereby is aligned with a cartridge in the rifle barrel to a cartridge loading position; a hammer and a trigger each pivotally connected to said block whereby, in said firing position of said breech-block pulling of the trigger releases said hammer to strike said firing pin; a lever pivotally connected to said receiver and to one end of a link which has its other end pivotally connected to said block to form a toggle linkage to move said block downwardly from and upwardly to said wedged firing position responsive to swinging of said lever in opposite directions; said receiver having a slot from which said action including said firing pin, said hammer, said trigger, said link, and said lever is bodily removable upon removal of the lever-receiver pivot; said receiver having a cartridge case extractor-ejector pivotally connected thereto, said extractor-ejector including a pin engaged behind the cartridge rim; said block and extractor-ejector having cooperating cam surfaces effective, upon downward movement of said block, to pivot said extractor-ejector in a direction whereby said pin extracts said cartridge case; said pin being spring-biased to eject the cartridge case.

6. The receiver of claim 5 wherein said block and extractor-ejector have other cooperating cam surfaces effective, upon upward movment of said block, to pivot said extractor-ejector in the opposite direction to position said pin behind the rim of the new cartridge loaded into said barrel.

7. The receiver of claim 6 wherein said receiver has a spring-biased plunger bearing on said extractor-ejector to provide spring-action pivotal movement of said extractor-ejector in the respective opposite directions after initial pivotal movement by the respective cooperating cam surfaces.

* * * * *